US005531606A

United States Patent [19]

Rodrigues et al.

[11] Patent Number: 5,531,606

[45] Date of Patent: Jul. 2, 1996

[54] SHIELDED VERTICALLY ALIGNED ELECTRICAL CONNECTOR COMPONENTS

[75] Inventors: Julio F. Rodrigues, Collierville; Paul Bartholomew, Memphis, both of Tenn.

[73] Assignee: Thomas & Betts Corporation

[21] Appl. No.: 92,142

[22] Filed: Jul. 14, 1993

Related U.S. Application Data

[63] Continuation-in-part of Ser. No. 13,452, Feb. 4, 1993.

[51] Int. Cl.[6] ..... H01R 33/96

[52] U.S. Cl. ..... 439/188; 439/608

[58] Field of Search ..... 439/188, 607, 439/608, 676, 535; 200/51.1

[56] References Cited

U.S. PATENT DOCUMENTS

| | | | |
|---|---|---|---|
| 3,654,592 | 4/1972 | Primorac | 439/637 |
| 4,106,841 | 8/1978 | Vladic | 439/637 |
| 4,516,825 | 5/1985 | Brennan et al. | 439/607 |
| 4,633,048 | 12/1986 | Komatsu | 439/188 |
| 4,659,163 | 4/1987 | Althouse et al. | 439/608 |
| 4,685,887 | 8/1987 | Hanning | 439/188 |
| 4,756,695 | 7/1988 | Lane et al. | 439/76 |
| 4,824,383 | 4/1989 | Lemke | 439/108 |
| 4,838,811 | 6/1989 | Nakamura et al. | 439/607 |
| 4,939,624 | 7/1990 | August et al. | 439/75 |
| 4,983,127 | 1/1991 | Kawai et al. | 439/79 |
| 5,052,948 | 10/1991 | Hyzin | 439/607 |
| 5,160,273 | 11/1992 | Carney | 439/608 |
| 5,178,554 | 1/1993 | Siemon | 439/188 |
| 5,228,871 | 7/1993 | Goodman | 439/607 |

*Primary Examiner*—Neil Abrams
*Attorney, Agent, or Firm*—Robert M. Rodrick

[57] ABSTRACT

An electrical connector component assembly terminates discrete conductors of a multiconductor data cable. The component assembly includes an insulative component housing (122, 124) having a mating end for engagement with a mating electrical connection device and a cable receiving end for terminating the multiconductor cable. A plurality of electrical contacts (126, 128) are supported by the component housing. Each of the contacts has a conductor terminating end and a mating connection end. The contacts are supported in the component housing in a pair of horizontally extending, vertically spaced rows with each contact of one row being aligned with a respective contact of the other row. The contacts of one row are directly electrically shunted (126*g*) to the aligned contacts of the other row. Electrical shielding (138, 139) is disposed around the contacts and includes a shield extension (168) extending between at least two of the contacts.

25 Claims, 7 Drawing Sheets

SHIELDED VERTICALLY ALIGNED ELECTRICAL CONNECTOR COMPONENTS

This is a continuation in part of U.S. patent application Ser. No. 08/013,452, filed Feb. 4, 1993.

FIELD OF INVENTION

The present invention relates to an improvement in electrical connector components. More particularly, the present invention relates to a shielded electrical connector for terminating a multiconductor cable having vertically aligned connector components.

BACKGROUND OF THE INVENTION

In transmitting data signals, electrical connectors are commonly used to terminate signal carrying multiconductor electrical cables which interconnect the various components of the data system. Many data systems require the components to be supported in an electrically closed loop. A closed-loop system provides for continuity of signal in a multicomponent system when certain of the components are not interconnected.

In order to achieve such a closed loop when the components are frequently connected and disconnected, the connectors connecting such components use automatic shunting mechanisms so that a closed-loop connection is maintained even when the connector is in a non-connected condition. The use of such shunting connectors in a closed-loop data system is shown in numerous patents including: U.S. Pat. Nos. Re. 32,760, 4,449,778, 4,501,459, 4,508,415, 4,582,376, 4,602,833, 4,619,494, 4,641,906, 4,653,825, 4,671,599, 4,682,836, 4,711,507, 4,711,511, 4,731,032, 4,744,769, 4,859,201, 4,883,433, 4,884,981, 4,891,022, 5,030,114, 5,030,121, 5,035,647, 5,052,940, 5,074,803, 5,088,934, 5,104,337, 5,112,243, 5,122,076 and 5,169,346.

While the connectors shown in the above-identified patents provide adequately for the connection of components in a data system, the increasing use of smaller components in such systems requires the use of smaller connectors. However, despite the reduction in size, these connectors still must provide closed loop connections.

Additionally, these connectors are designed to carry signals at increasingly higher data rates. At such higher data rates, cross-talk interference between components of the connector also increases. Thus, these connectors must include adequate shielding so as to reduce cross-talk interference between connector components.

It is, therefore, desirable to provide a data connector of reduced size, which provides adequate shunting to maintain closed-loop connections and which provides adequate shielding.

SUMMARY OF THE INVENTION

It is an object of the present invention to provide an improved electrical data connector.

It is a further object of the present invention to provide data connector components of reduced size which provide for adequate shunting.

It is a still further object of the present invention to provide a data connector having vertically aligned components.

It is still another object of the present invention to provide improved shielding in a data connector having vertically aligned components so as to reduce cross-talk interference between contacts of the connector.

In the efficient attainment of these and other objects, the present invention provides an electrical connector including an insulative housing having a mating end for engagement with a mating connector device and a terminating end. Plural electrical contacts are supported in the housing. The contacts are arranged in vertically spaced horizontally extending upper and lower rows. Each contact of one row being paired in vertically stacked relationship with a contact of the lower row. Shunting means is included for operatively electrically shunting the contacts of each of the vertically stacked pairs. Conductive shielding is supported within the insulative housing. The shielding includes portions extending between at least two of the contacts in each of the upper and lower rows and between the shunting means associated therewith.

As more particularly described by way of the preferred embodiment herein, the connector includes the upper row of contacts having a downwardly depending shunt member extending for engagement with portions of the lower contacts. The conductive shielding extends between two of the contacts in each row and also between the downwardly depending shunt member.

DETAILED DESCRIPTION OF THE PREFERRED EMBODIMENT

Figure 1:
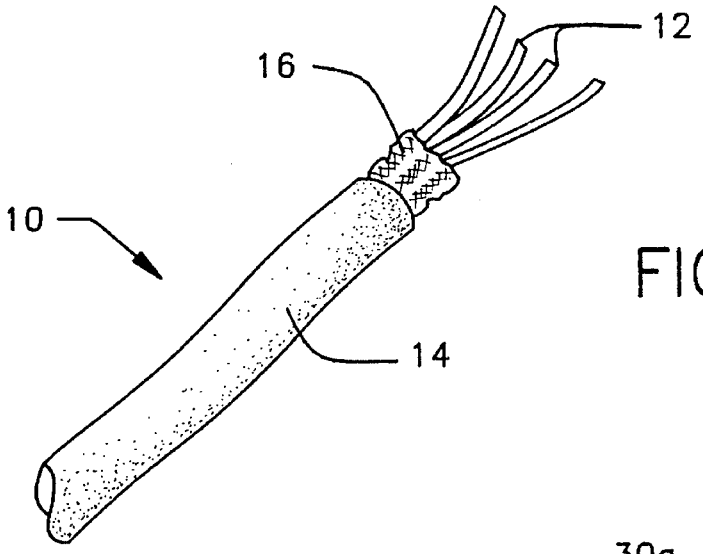
FIG. 1 shows a shielded multiconductor electrical cable used in combination with the present invention.

Referring to FIG. 1, an electrical cable 10 of the type used in accordance with the present invention is shown. Electrical cable 10 is a multiconductor data transmission cable including a plurality of insulated conductors 12 enclosed in an outer insulative jacket 14. A metallic shield 16 is interposed between the conductors 12 and the jacket 14. Shield 16, as is well-known in the art, is used to provide electrical shielding for cable 10. In the present illustrative embodiment, a braided shield 16 is shown. However, shields of other construction, such as metallic foil, may also be employed. Cable 10 is shown prepared for termination with end portions of conductors 12 extending outwardly of jacket 14. A portion of shield 16 is also shown extending from jacket 14.

Figure 2:
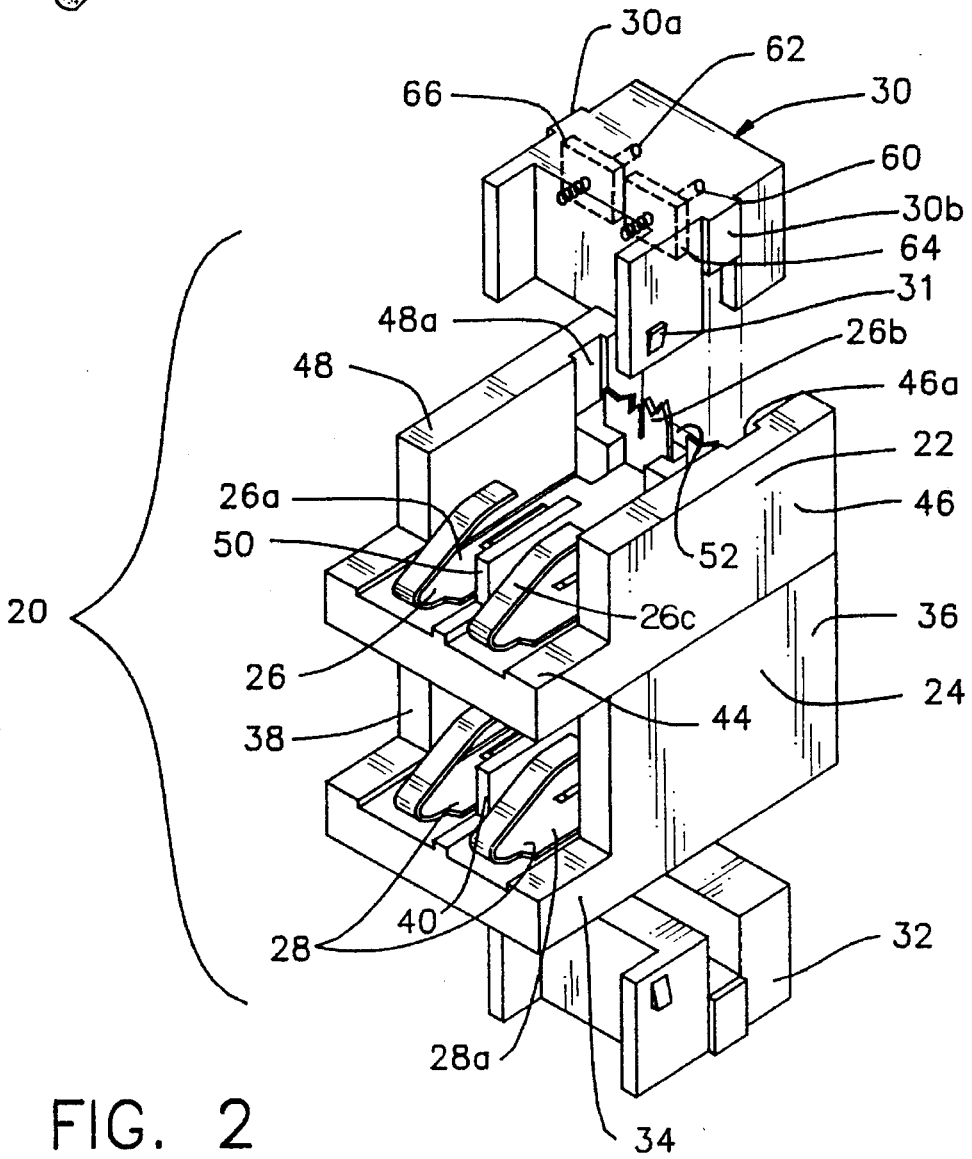
FIG. 2 is a perspective showing of the electrical connector component assembly of the present invention.
Figure 3:
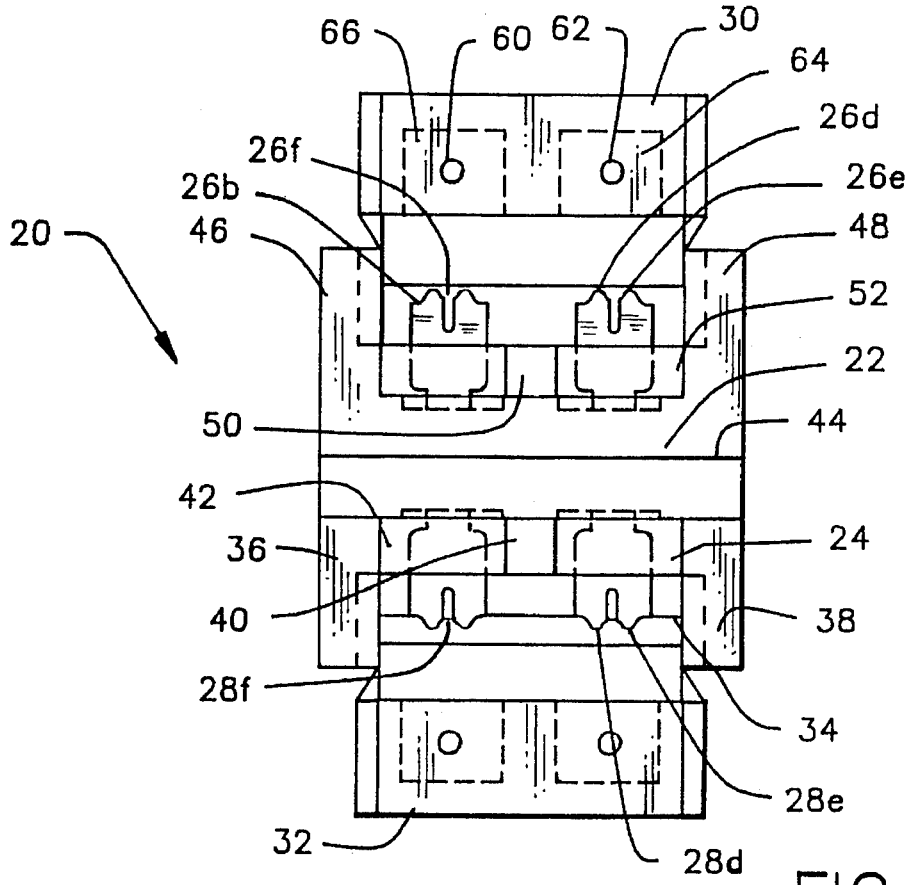
FIGS. 3 and 4 are rear-plan and side-elevational showings, respectively, of the electrical connector component assembly of FIG. 2.
Figure 4:
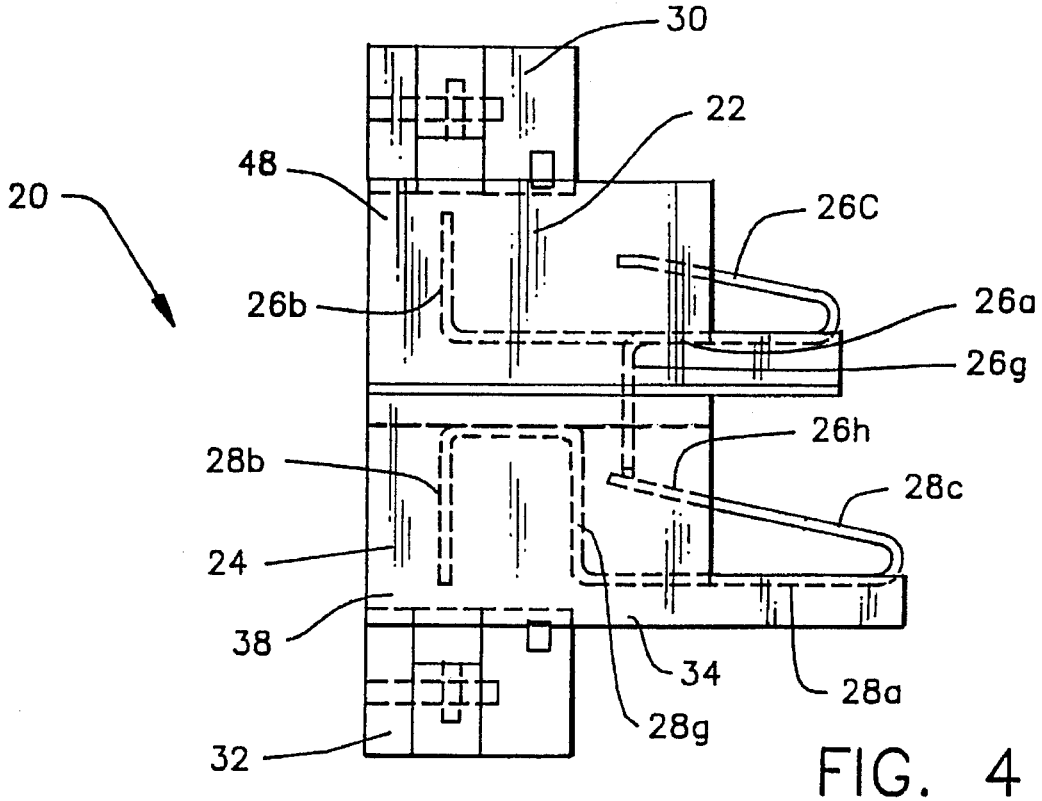

Referring to FIGS. 2–4, the electrical connector component assembly 20 of the present invention may be described. Assembly 20 includes first and second electrically insulative housings 22 and 24 arranged in a vertically stacked relationship. Each housing 22 and 24 supports a pair of electrical contacts 26 and 28 respectively. Assembly 20 further includes a pair of conductor support blocks 30 and 32 which are engagable with housings 22 and 24, respectively, to support conductors 12 of electrical cable 10 in electrical engagement with contacts 26 and 28, as will be further described hereinbelow.

Electrical connector component assembly 20 may be housed within an electrically shielded housing (not shown) to permit electrical interconnection with a further connection device. Connector component assembly 20 and its associated shielded housing may be constructed to be of the hermaphroditic variety so that it will permit interconnection to an identically formed member. Connectors of such construction are shown in several of the above-identified U.S. patents, most notably, U.S. Pat. No. 4,682,836.

Housing 24, which is the lower of the two housings shown in the drawings, includes a bottom wall 34 and two transversely spaced upstanding sidewalls 36 and 38. An upstanding dividing wall 40 suitably electrically isolates contacts 28. As shown in FIG. 3, a transverse wall 42 of height less than the sidewalls extends across a rear portion of bottom wall 34.

Electrical contacts 28 are supported by housing 24. Contacts 28 are formed of a suitably conductive stamped and formed metallic material such as beryllium copper. Contacts 28 include a generally elongate base portion 28*a*, an insulation displacement contact (IDC) portion 28*b* and a reversely bent cantilevered spring portion 28*c*, which extends back over base portion 28*a*. IDC portion 28*b* is of conventional flat-blade configuration, having two spaced relatively sharp tines 28*d* and 28*e*, defining therebetween a conductor receiving slot 28*f*. IDC portion 28*b* is shown extending in a direction opposite that of reversely bent cantilevered spring portion 28*c* so that it may be accessible adjacent bottom wall 34. A contact transition portion 28*g* provides for the inversion of IDC portion 28*b*. Contacts 28 are fixedly secured in housing 24 with contact base portion 28*a* positioned along bottom wall 34. Appropriate housing structure (not shown) inclusive of transverse wall 42 may be employed to support IDC portion 28*b* in housing 24.

Cantilevered spring portion 28*c* is deflectable to move toward and away from base portion 28*a* upon interconnection of a further connecting device in a manner well-known in the art. Upon interconnection, cantilevered spring portion 28*c* will deflect downwardly toward base portion 28*a*, returning to its original position shown in FIG. 4 upon disconnection.

Housing 22, shown as the upper housing in the drawings, is of substantially similar construction to that of housing 24. Housing 22 includes a bottom wall 44 and two transversely spaced upstanding sidewalls 46 and 48. An upstanding dividing wall 50 electrically isolates contacts 26. A transverse wall 52 of height less than the sidewalls extends upwardly from a rear portion of bottom wall 44.

Contacts 26 are of construction similar to that of contacts 28 described above. Contacts 26 include an elongate base portion 26*a*, an insulation displacing contact (IDC) portion 26*b* and a reversely bent cantilevered spring portion 26*c*. IDC portion 26*b* is also of generally flat blade configuration, having sharp tines 26*d* and 26*e* defining therebetween a conductor receiving slot 26*f*. IDC portion 26*b* extends upwardly from base 26*a* in the direction of cantilevered spring portion 26*c*, which is of opposite construction to that of contact 28. Thus, the IDC portions 26*b*, 28*b* of contacts 26 and 28 are accessible from opposite directions.

Figure 5:
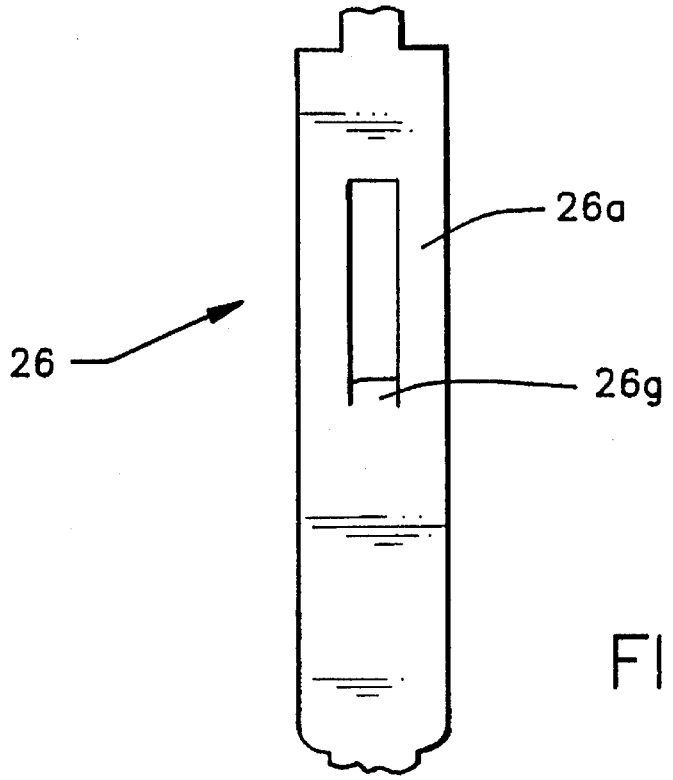
FIGS. 5 and 6 are top and side fragmented showings, respectively, of an electrical contact used in the electrical connector component assembly shown in FIG. 2.
Figure 6:
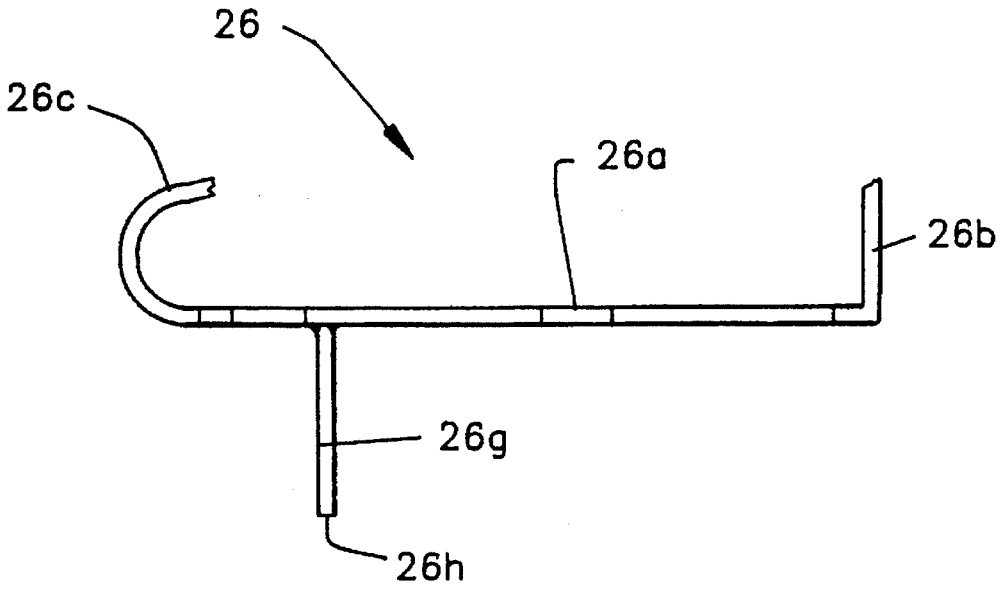

As shown in FIGS. 5 and 6, each contact 26 further includes a depending shunt portion 26*g*. Shunt portion 26*g* is struck from a central extent of the planar base portion 26*a* and is bent downwardly out of the plane of base portion 26*a* to extend at an angle of approximately 90° with respect thereto.

Referring again to FIGS. 2–4, contacts 26 are fixedly secured in housing 22 with each contact 26 being supported on bottom wall 44. Transverse wall 52 is appropriately constructed to support IDC portions 26*b* of contacts 26. Further, bottom wall 44 includes a pair of openings (not shown) which permit shunt portions 26*g* of contacts 26 to extend therethrough.

As shown particularly in FIG. 4, shunt portion 26*g* of each contact 26 extends downwardly toward contact 28, which is vertically aligned therewith, such that a distal extent 26*h* electrically engages cantilevered spring portion 28*c*. In this condition, contact 26 is electrically shunted to contact 28.

As above described, cantilevered spring portion 28*c* of contact 28 is deflectable toward and away from base portion 28*a*. Upon interconnection of another connecting device, cantilevered spring portion 28*c* of contact 28 will deflect downwardly from the position shown in FIG. 4 so that cantilevered spring portion 28*c* is out of engagement with depending shunt portion 26*g* of contact 26. Upon disconnection, cantilevered spring portion 28*c* will return to its original position, as shown in FIG. 4, reconnecting with depending shunt portion 26*g* of contact 26.

To facilitate the termination of cable 10 to connector component assembly 20, conductor support blocks 30 and 32 are employed. Support blocks 30 and 32 are of substantially similar construction. Referring to support block 30 as an example, block 30 is formed of suitably insulative molded plastic and includes a pair of spaced conductor receiving bores 60 and 62, which accommodate two conductors 12 of cable 10. A pair of IDC receiving slots 64 and 66 are positioned adjacent conductor receiving bores 60 and 62 and are in communication therewith. In order to terminate cable 10, two of the conductors 12 are inserted into bores 60 and 62 of block 30. The block 30 is then inserted into housing 22 such that IDC portions 26*b* are accommodated in IDC receiving slots 64 and 66. Appropriate mating structure on sidewalls 46 and 48 and on conductor support block 30 facilitates insertion of support block 30 into housing 22. As shown in FIG. 2, sidewalls 46 and 48 include vertical slots 46*a* and 48*a* which accommodate extending tongues 30*a* and 30*b* of block 30. However, other mating structure may also be employed. Also, a latch or detent such as shown as 31 on block 30 may be employed to provide for a snap fit of block 30 in housing 22. Support block 30, including conductors 12 supported therein, may be manually inserted or inserted under application of an appropriate tool such that conductors 12 are electrically terminated with IDC portions 26*b* in a manner well-known in the connector art. Conductor support block 30 may be formed of a clear molded plastic so that the proper termination of conductors 12 to IDC portions 26*b* may be observed.

Conductor support block 32, being substantially similar to that of conductor support block 30, operates in the same manner to terminate the other two conductors 12 of cable 10 to contacts 28 supported in housing 24. In fact, it is contemplated that conductor support block 32 may be identical to conductor support block 30 so that a single construction may be used in both instances.

As above-mentioned, connector component assembly 20 is supported within a shielded housing for interconnection purposes. The shield of that housing would be appropriately electrically connected to shield 16 of cable 10 which extends from jacket 14. Therefore, in order to maintain shielded isolation as between contacts 26 and 28, the present invention contemplates interposing a metallic shield between housing 22 and housing 24. This metallic shield would be electrically continuous with the shield of the outer housing, which is in turn connected to the shield 16 of cable 10.

Figure 7:
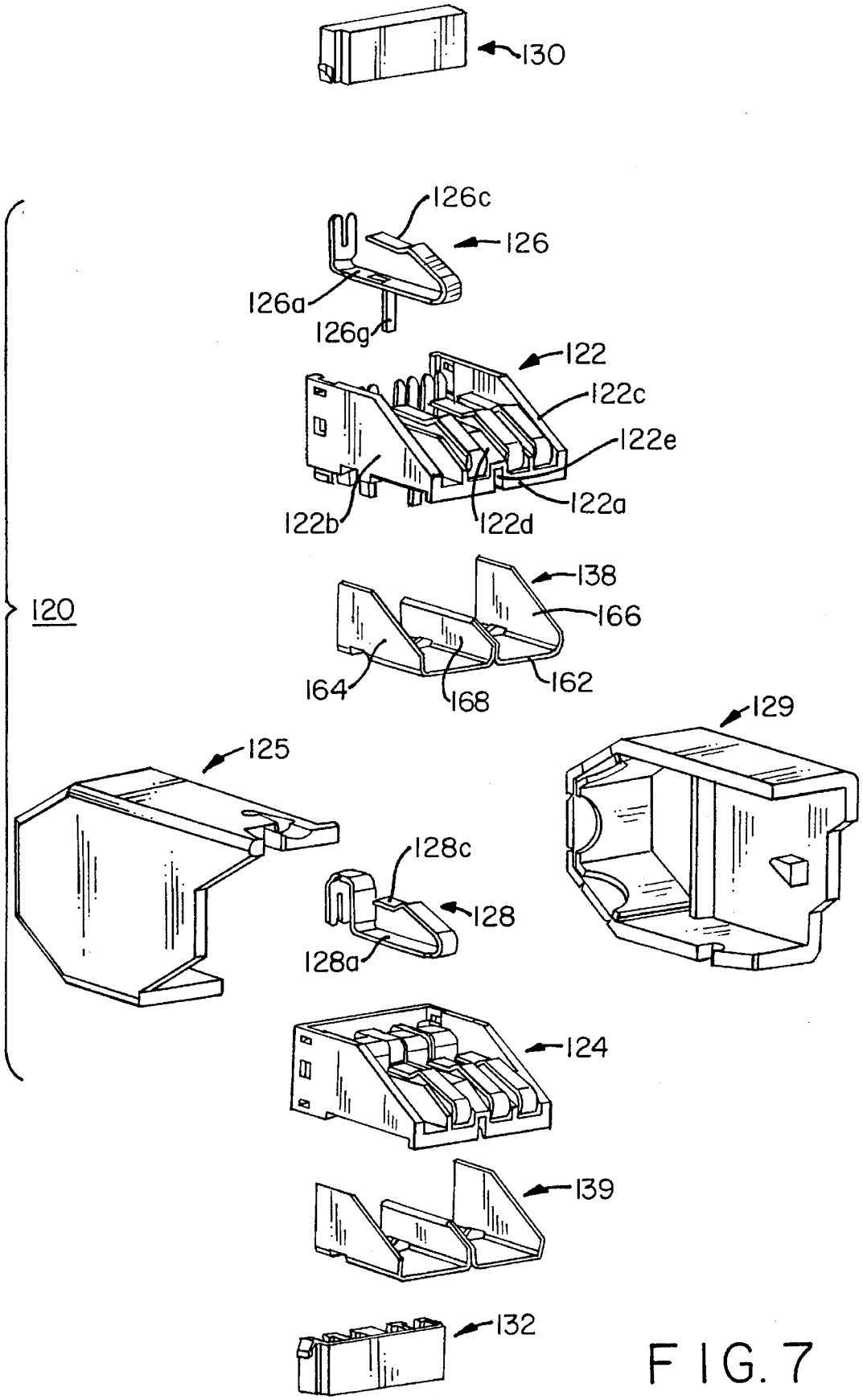
FIG. 7 is an exploded perspective view of a further embodiment of the electrical connector component assembly of the present invention.

Referring to FIG. 7, a preferred embodiment of the present invention is shown. For simplicity of explanation, like reference numerals are used to denote like components.

Electrical connector component assembly 120 includes first and second electrically insulative housings 122 and 124 arranged in vertically stacked relationship. Each housing 122 and 124 supports four electrical contacts 126 and 128, respectively. Assembly 120 further includes a pair of insulative support blocks 130 and 132 which are engagable with housings 122 and 124, respectively, to support conductors 12 of electrical cable 10 (FIG. 1) in electrical engagement with contacts 126 and 128 in a manner similar to that described hereinabove.

Electrical connector component assembly 120 further includes an outer electrically shielded outer housing 131 formed of side by side insulative housing members 125 and 129 which support the remainder of the components of connector component assembly 120, such housing members 125 and 129 supporting an electrical shield therein.

Housings 122 and 124 support contact shields 138 and 139, respectively. Housing 122, which is substantially similar to housing 124, includes a bottom wall 122*a* and transversely spaced upstanding side walls 122*b* and 122*c*. A central upstanding dividing wall 122*d* separates the contacts 126 supported therein into two side by side pairs. A central slot 122*e* extends through upstanding dividing wall 122*d* for accommodation of shield 138 as will be described in further detail hereinbelow.

Contacts 126 are substantially similar to contacts 26 described above and include a depending shunt portion 126*g* extending from planar base portion 126*a*. Contacts 128 are substantially similar to contacts 28 described above and include a cantilevered spring portion 128*c* which is designed for engagement with shunt portion 126*g* in a manner shown and described with respect to FIGS. 5 and 6 above. While contacts 126 and 128 are shown as being stamped and formed metallic members with cantilevered portions 126*c* and 128*c* being reversely bent back over central base portions 126*a* and 128*a*, other contact configurations may also be employed.

One such particular configuration where the contacts are stamped such that the cantilevered spring portions are struck from the central base portion and bent out of the plane thereof are shown and described in copending application Ser. No. 08/092,049, filed at even date herewith entitled Shielded Compact Data Connector and assigned to the assignee of the present invention.

Each of housings 122 and 124 are constructed to accommodate shields 138 and 139, respectively therein. Shield 138, which is substantially similar to shield 139, is a metallic member formed of stamped material having a bottom planar surface 162, which is constructed to be in conformance with bottom wall 122*a* of housing 122, and a pair of upstanding transversely spaced side extensions 164 and 166. A planar central extension 168 extends upwardly from bottom planar surface 162 between side extensions 164 and 166. Side extensions 164 and 166 are constructed to be received along side walls 122*b* and 122*c*, respectively, and central extension 168 is designed to be received within central slot 122*e* of upstanding dividing wall 122*d*.

Each of side extensions 164 and 166 and central extension 168 is of sufficient height and length to span the length of contacts 126 supported therein including depending shunt member 126*g* so as to provide cross-talk shielding for the contacts supported on either side of upstanding dividing wall 122*a*. Thus, contact shield 138 in combination with contact shield 139 of lower housing 124 assures that adequate cross-talk shielding is provided between contacts 126 and 128 supported within connector component assembly 120. The contact shields 138 and 139 are constructed generally in accordance with the description set forth in U.S. patent application Ser. No. 08/013,857, entitled "Enhanced Performance Data Connector," filed on Feb. 5, 1993, assigned to the same Assignee as the subject invention, and incorporated herein by reference. While a stamped and formed shield is shown in FIG. 7, it is contemplated that contact shields 138 and 139 may be integrally formed into a one-piece member formed of die cast metal.

Figure 8:
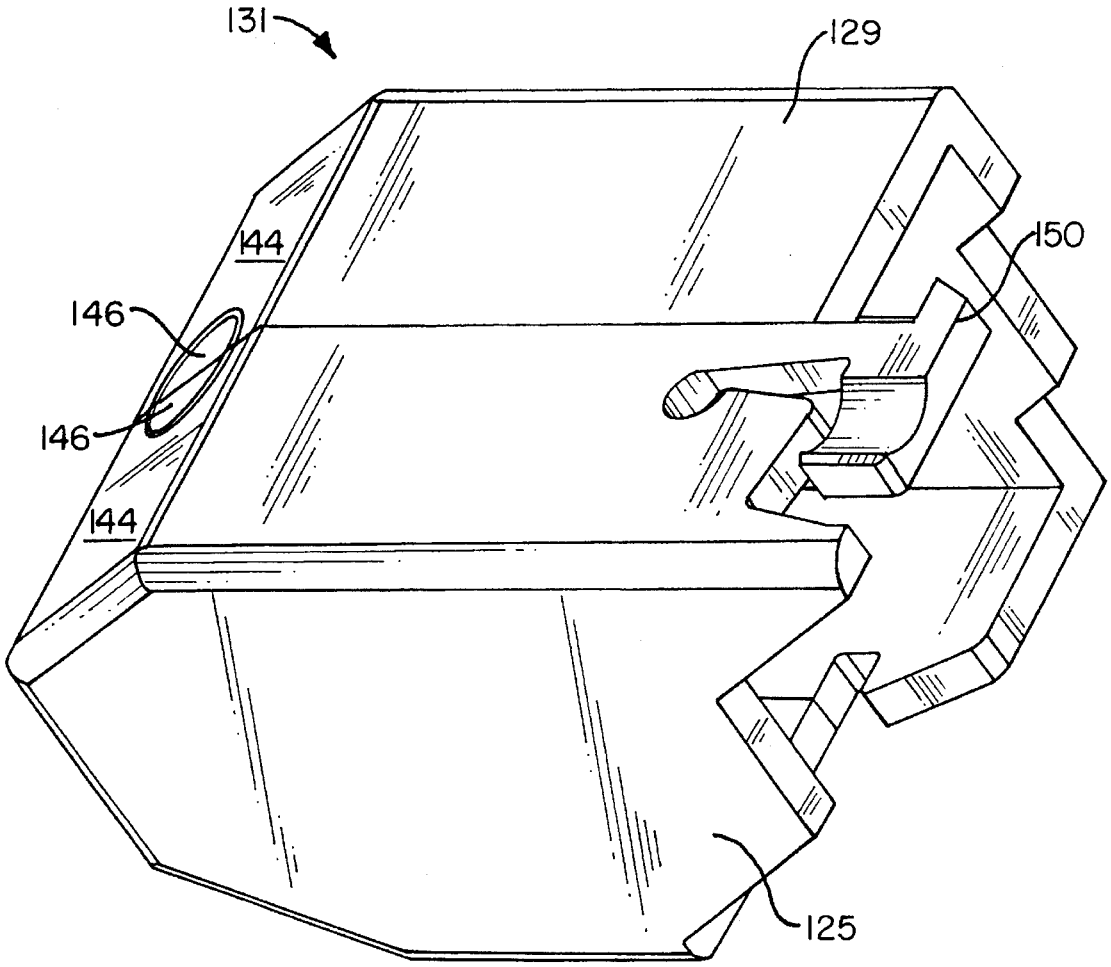
FIG. 8 is a perspective showing of the outer housing of the electrical connector component assembly of FIG. 7.
Figure 9:
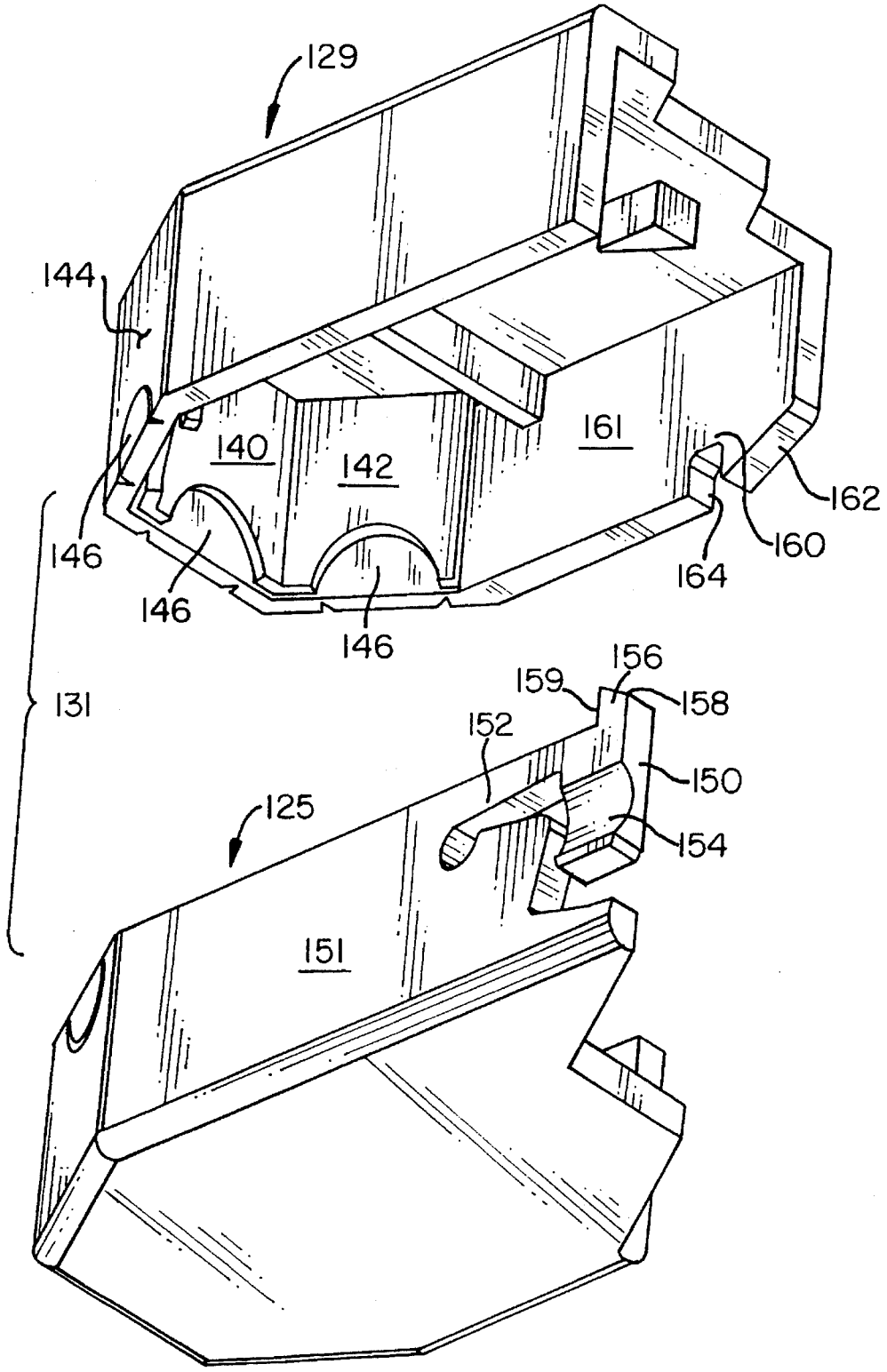
FIG. 9 is an exploded perspective view of the outer housing of FIG. 8.

Referring additionally to FIGS. 8 an 9, outer housing members 125 and 129 are shown being matable members forming overall outer housing 131. Outer housing members 125 and 129 have generally similar configurations.

Referring to outer housing member 129, it includes three angularly disposed back walls. Central back wall 140 is flanked by lateral walls 142 and 144 which are disposed at generally 45° angles therefrom. Each of walls 140, 142 and 144 includes a semi-circular frangible housing portion 146. Frangible housing portion 146 may be manually removed creating a semi-circular aperture for passage of electrical cable 10 therethrough. As shown in FIG. 8, when connector housing member 125 is secured to connector housing member 129, both semi-circular frangible members 146 and 148 form a full circular member which facilitates such cable passage. Thus, cable 10 may be inserted into outer connector housing 131 in either straight through fashion or at 45° angles therefrom.

Figure 10:
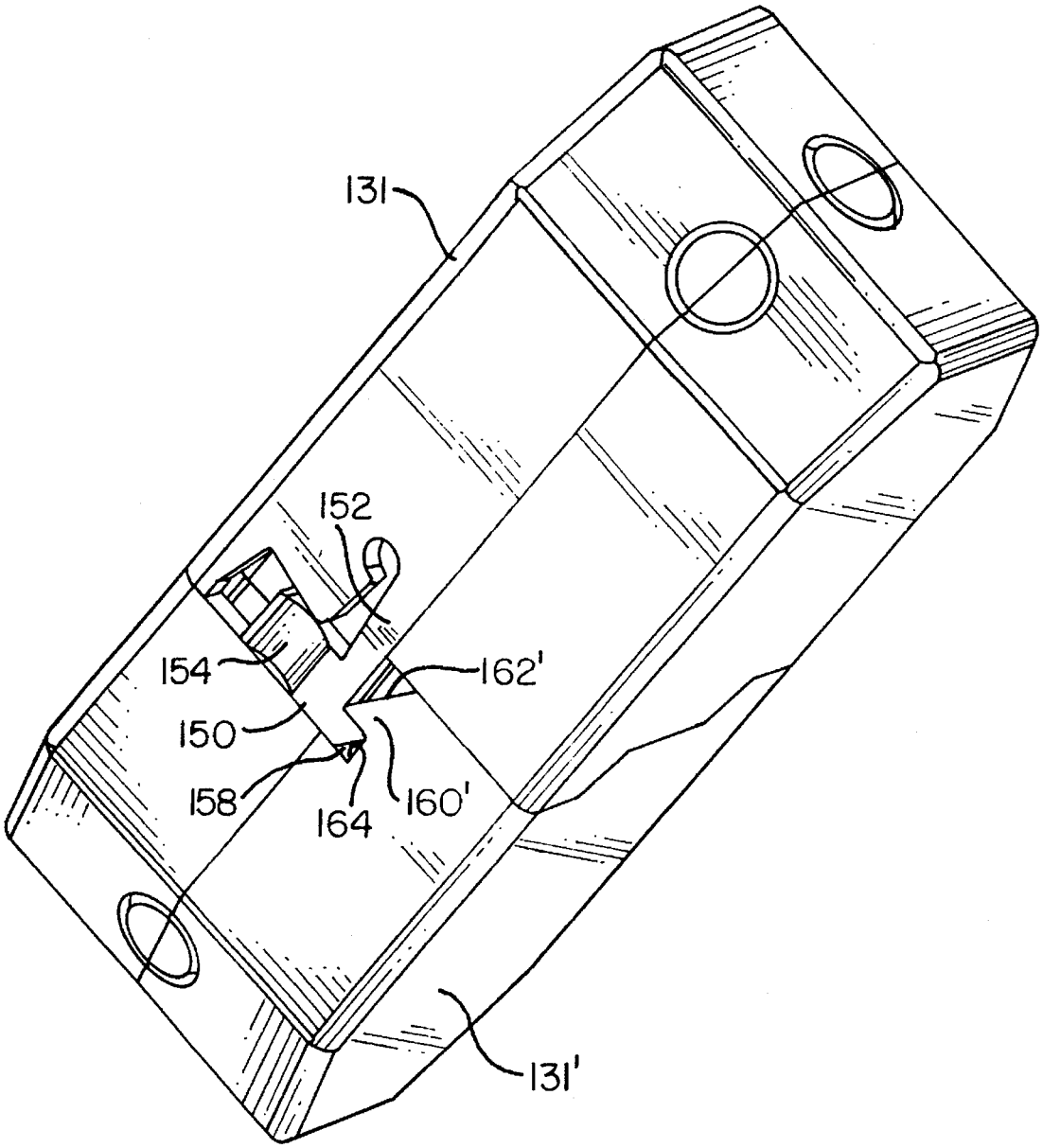
FIG. 10 shows electrical connector component assembly of FIG. 7 shown connected to a like connector in hermaphroditic fashion.

Outer connector housing 131 when assembled is designed for hermaphroditic mating in a manner shown in FIG. 10. In that regard, connector housing member 125 includes a deflectable connector latch 150 which comprises a cantilevered arm 152, a manually actuatable surface 154 and a locking member 156. Locking member 156 includes ramped engagement wall 158 and a locking wall 159 which extends downwardly from ramped engagement wall 158.

Outer housing member 129 includes a latch retention member 160 which is supported on a wall 161 opposite wall 151 which supports latch 150. Latch retention member 160 includes a ramped wall 162 and a recess 164 beginning at the upper edge of ramped wall 162.

As shown in FIG. 10, outer connector housing 131 is designed for hermaphroditic interconnection with like connector 131'. As can be seen, latch 150 of outer connector housing 131 is designed for matable locking interconnection with latch engagement member 160' of outer connector housing 131'. Upon connecting outer housing 131 to outer housing 131', ramped wall 158 of locking member 156 engages ramped wall 162 of latch engagement member 160'. This action causes the deflection of cantilevered arm 152, permitting such interaction. Upon reaching the end of respective ramp walls, latch member 156 is forced into recess 164' by the spring bias of cantilevered arm 152 thus locking latch 150 to latch retention member 160'. A similar interaction occurs on the other side of outer connector housings 131 and 131' with respect to latch 150' and latch retention member 160 (not shown).

In order to release outer connector housing 131 from outer connector housing 131', manually actuatable surface 154 may be actuated by the installer to move against the bias of cantilevered arm 152 to release latch 150 from recess 164'. This will cause engagement of ramped walls 158 and 162' thereby disconnecting housing 131 from housing 131'. While manually actuatable surface 154 is shown to be a curved recessed member, it is also contemplated that a bump or protrusion with griping elements may be employed to facilitate easy manual engagement of the latch by the fingers of the installer.

Various changes to the foregoing described and shown structures would now be evident to those skilled in the art. Accordingly, the particularly disclosed scope of the invention is set forth in the following claims.

We claim:

1. An electrical connector comprising:

an insulative housing having a mating end for engagement with a mating electrical connection device and a terminal end;

plural electrical contacts supported within said housing, said contacts being arranged in vertically spaced horizontally extending upper and lower rows, each contact of one row being paired in vertically stacked relationship with a contact of said other row;

shunting means for operatively electrically shunting said contact of each said vertically stacked pair;

a conductive shield supported within said insulative housing, said shield including a vertical shield portion extending vertically between portions of said shunting means associated with two contacts of at least one of said rows of contacts and a horizontal shield portion extending horizontally between said upper and lower rows of contacts.

2. An electrical connector of claim 1 wherein said shunting means includes each of the contacts of one of said upper rows including a depending shunt portion, each said shunt portion for engagement with one of said contacts of said lower row.

3. An electrical connector of claim 1 wherein said conductive shield includes a pair of shield members.

4. An electrical connector of claim 3 wherein said conductive shield members each include lateral shield portions projecting upwardly from a respective horizontal shield portion and extending on each side of each of said upper and lower rows.

5. An electrical connector of claim 4 wherein said conductive shield members each include a vertical shield portion extending between said shunt portions of two of said contacts of each of said upper and lower rows.

6. A shielded electrical connector comprising:

an insulative housing having a mating end for engagement with a mating electrical connection device and a termination end;

plural electrical contacts supported by said housing, said contacts being arranged in vertically spaced horizontally extending upper and lower rows, there being at least two contacts in each of said rows, each contact of one row being paired in vertically stacked relationship with a contact of said other row, each of said contacts having a mating engaging portion of hermaphroditic configuration to electrically mate with identical mating engaging portions of contacts on said mating electrical connection device; and a conductive shield supported within said insulative housing, said shield including a horizontal shield portion extending horizontally between said upper and lower rows of contacts and a vertical shield portion in each row extending vertically between said at least two contacts in each said row.

7. A shielded electrical connector of claim 6 wherein said conductive shield comprises a pair of shield members, each shield member including a horizontal shield portion and a vertical shield portion.

8. A shielded electrical connector of claim 7 wherein said horizontal shield portion of each shield member includes a planar portion lying below and substantially parallel to said contacts in said respective rows.

9. A shielded electrical connector of claim 8 wherein each shield member further comprises a pair of spaced, lateral shield portions, said lateral shield portions projecting upwardly from said horizontal shield portion and extending vertically adjacent the respective sides of said contacts in each row, each said vertical shield portion being generally centrally disposed between said lateral shield portions.

10. A shielded electrical connector of claim 9 wherein each of said vertical shield portions has a planar portion having a length sufficient to span the length of said contacts in said respective rows.

11. A shielded electrical connector of claim 9 wherein each of said lateral shield portions include a planar portion.

12. A shielded electrical connector of claim 6, further including a shunt element extending vertically between a pair of vertically stacked contacts in each row, said shunt member engaging said vertically stacked contacts when said electrical connector is not mated with said electrical connection device and operative upon mating with said mating electrical connector device to be separated from at least one contact in said upper or lower row.

13. A shielded electrical connector of claim 12 wherein a shunt element extends between all stacked pairs of contacts in said upper and lower rows.

14. A shielded electrical connector of claim 13 wherein said respective shunt members are integrally formed with said contacts in one of said upper and lower rows.

15. A shielded electrical connector of claim 6 wherein said conductive shield is an integral member including said horizontal shield portion and said vertical shield portion.

16. A shielded electrical connector of claim 6 wherein said housing includes an upstanding dividing wall separating said at least two contacts of one of said rows, said upstanding dividing wall including a slot therein for receipt of said vertical shield portion.

17. A shielded electrical connector comprising:

an insulative housing having a mating end for engagement with a mating electrical connection device and a termination end;

a plurality of electrical contacts supported by said housing, said contacts having terminating ends and mating connection ends, said contacts being supported in said housing in vertically spaced, horizontally extending rows, there being at least two contacts in each row, each contact of one row being vertically aligned with a respective contact of the other row, each contact mating end including a vertically deflectable portion, all said deflectable portions of contacts in said rows being deflectable in the same direction upon interconnection with said mating electrical connections device, and a conductive shield supported within said housing, said shield having an extent overlying at least a portion of said contacts in one of said rows.

18. A shielded electrical connector of claim 17 wherein said contact mating ends are hermaphroditic and are of configuration to electrically mate with identical contact mating ends on said mating electrical connection device.

19. A shielded electrical connector of claim 18 wherein said contact mating ends are configured in cantilevered form.

20. A shielded electrical connector of claim 17 wherein said conductive shield includes a horizontal shield portion extending horizontally between said vertically spaced rows.

21. A shielded electrical connector of claim 17 wherein said conductive shield includes a vertical shield portion extending vertically between said at least two contacts in each said row.

22. A shielded electrical connector of claim 21 wherein said conductive shield includes a horizontal shield portion extending horizontally between said vertically spaced rows.

23. A shielded electrical connector of claim 22 wherein said conductive shield comprises a pair of shield members, each shield member including a horizontal shield portion and a vertical shield portion.

24. A shielded electrical connector of 17, further including shunting means for operatively shunting said contacts of each vertically aligned pair of contacts.

25. A shielded electrical connector of claim 22 wherein said vertical shield portions and said horizontal shield portions are integrally formed.

* * * * *